US006050648A

United States Patent [19]

Keleny

[11] Patent Number: 6,050,648

[45] Date of Patent: Apr. 18, 2000

[54] IN-LINE SKATE WHEEL

[75] Inventor: Lloyd Gerhardt Keleny, Champlin, Minn.

[73] Assignee: Rollerblade, Inc., Eden Prairie, Minn.

[21] Appl. No.: 09/042,245

[22] Filed: Mar. 13, 1998

Related U.S. Application Data

[63] Continuation-in-part of application No. 08/816,849, Mar. 13, 1997.

[51] Int. Cl.[7] ..... A63C 17/22

[52] U.S. Cl. ..... 301/5.3; 301/64.7; 152/323

[58] Field of Search ..... 301/5.3, 5.7, 64.7; 280/11.19, 11.22, 11.23; 152/1, 5, 7, 8, 9, 10, 323, 324, 325, 326, 327, 328, 329, 393, 394, 395

[56] References Cited

U.S. PATENT DOCUMENTS

| | | |
|---|---|---|
| 108,184 | 10/1870 | Pollitt . |
| 243,979 | 7/1881 | Ross . |
| 282,156 | 7/1883 | Burton . |
| 284,009 | 8/1883 | Henry . |
| 285,836 | 10/1883 | Otis . |
| 320,774 | 6/1885 | Gardner . |
| 321,873 | 7/1885 | Wicker . |
| 1,687,113 | 10/1928 | Stockdale . |
| 2,570,349 | 10/1951 | Kardhordo . |
| 2,878,071 | 3/1959 | Fowlkes . |
| 3,396,773 | 8/1968 | Alderfer . |
| 3,574,317 | 4/1971 | Brewer . |
| 3,854,516 | 12/1974 | Burnell . |
| 3,936,061 | 2/1976 | Wada . |
| 3,987,832 | 10/1976 | Funke . |
| 4,033,395 | 7/1977 | Berg et al. . |
| 4,040,670 | 8/1977 | Williams . |
| 4,058,152 | 11/1977 | Beck et al. . |
| 4,294,491 | 10/1981 | Black . |
| 4,472,340 | 9/1984 | Boden et al. . |
| 4,699,432 | 10/1987 | Klamer . |
| 4,855,096 | 8/1989 | Panaroni . |
| 4,909,972 | 3/1990 | Britz . |
| 4,940,445 | 7/1990 | Desportes . |
| 4,966,212 | 10/1990 | Hill . |
| 5,018,795 | 5/1991 | Engerand et al. . |
| 5,028,058 | 7/1991 | Olson . |
| 5,073,444 | 12/1991 | Shanelac . |
| 5,080,444 | 1/1992 | Hopkins et al. . |
| 5,092,614 | 3/1992 | Malewicz . |
| 5,129,709 | 7/1992 | Klamer . |
| 5,186,676 | 2/1993 | Morton . |
| 5,265,659 | 11/1993 | Pajtas et al. . |
| 5,310,250 | 5/1994 | Gonsior . |
| 5,312,165 | 5/1994 | Spletter . |
| 5,320,418 | 6/1994 | Chen . |

(List continued on next page.)

FOREIGN PATENT DOCUMENTS

| | | |
|---|---|---|
| 0 295 081 | 12/1988 | European Pat. Off. . |
| 0 571 629 A1 | 12/1993 | European Pat. Off. . |
| 0 714 682 A2 | 6/1996 | European Pat. Off. . |
| 1036857 | 9/1953 | France . |
| 628872 | 4/1936 | Germany . |
| 1 031 192 | 5/1958 | Germany . |
| MI 92U/00823 | 12/1994 | Italy . |
| MI 92U/00824 | 12/1994 | Italy . |
| 530 804 | 5/1973 | Switzerland . |
| WO 80/00236 | 2/1980 | WIPO . |

OTHER PUBLICATIONS

Photographs of Hyper Wheel Containing Hollow Tube. (No Date).

*Primary Examiner*—Russell D. Stormer
*Attorney, Agent, or Firm*—Merchant & Gould P.C.

[57] ABSTRACT

An in-line skate wheel includes an polyethylene closed cell foam ring surrounding the outer cylindrical surface of a hard plastic hub. Polyurethane is molded onto the outer cylindrical surface of the hub and surrounding the polyethylene ring. The polyethylene ring is provided with a substantially lower density than the density of the polyurethane.

18 Claims, 6 Drawing Sheets

U.S. PATENT DOCUMENTS

| | | | |
|---|---|---|---|
| 5,351,974 | 10/1994 | Cech . | |
| 5,362,075 | 11/1994 | Szendel . | |
| 5,401,037 | 3/1995 | O'Donnell et al. . | |
| 5,411,320 | 5/1995 | Alderman et al. . | |
| 5,503,466 | 4/1996 | Lew . | |
| 5,527,100 | 6/1996 | O'Donnell et al. . | |
| 5,567,019 | 10/1996 | Raza et al. . | |
| 5,573,309 | 11/1996 | Bekessy . | |
| 5,630,891 | 5/1997 | Peterson et al. . | |
| 5,632,829 | 5/1997 | Peterson et al. . | |
| 5,641,365 | 6/1997 | Peterson et al. . | |
| 5,725,284 | 3/1998 | Boyer | 301/5.3 |
| 5,797,658 | 8/1998 | Larrucea | 301/5.3 |
| 5,860,707 | 1/1999 | Keleny | 301/5.3 |

IN-LINE SKATE WHEEL

CROSS REFERENCED TO RELATED APPLICATION

This application is a continuation-in-part of U.S. application Ser. No. 08/816,849, filed Mar. 13, 1997, and entitled "IN-LINE SKATE WHEEL".

I. BACKGROUND OF THE INVENTION

1. Field of the Invention

This invention pertains to in-line roller skates and more particularly to an improved wheel for use with in-line roller skates.

2. Description of the Prior Art

In recent years, in-line skating has become enormously popular. Such skates include a plurality of wheels mounted for rotation in a common plane. The axles of the wheels are mounted in parallel spaced-apart alignment.

Traditionally, in-line skate wheels include a rigid cylindrical plastic hub through which axles pass. Polyurethane is then molded onto the outer cylindrical surface of the hub to form a complete wheel. An example of such a construction is shown in U.S. Pat. No. 5,567,019 to Raza et al dated Oct. 22, 1996.

Polyurethane is a very dense material having a density of about 1.02 to 1.2 grams per cubic centimeter. Not uncommonly, a single in-line skate may have four wheels such that a pair of skates will have eight wheels. Accordingly, the wheels can comprise a significant part of the weight of the skate.

To improve comfort and performance of skates, weight reduction is an important goal of in-line skate design. Due to the significant percentage of a skate's weight associated with the wheels, weight reduction of wheels is desirable. Also, it is desirable to maintain the performance of the wheels including bounce, rolling resistance and rebound action.

One design which results in reduced weight of the wheel is to provide a flexible hollow tube in the form of a ring surrounding the hub. A polyurethane tire is molded onto the hub surrounding the hollow tube. Since the tube is hollow, the air volume of the tube is at a substantially lower density than the molded polyurethane resulting in reduced weight loss of the wheel. However, such a design is unsightly. Also, the design is not sufficiently flexible to permit modification of the performance by varying the design parameters. It is an object of the present invention to provide an enhanced wheel design with reduced weight, acceptable performance, attractive appearance and susceptible of selective modification to selectively adjust performance of the wheel.

II. SUMMARY OF THE INVENTION

According to a preferred embodiment of the present invention, a skate wheel is disclosed which includes a generally cylindrical hub having an axle opening. An outer layer of a first synthetic plastic material is molded onto the hub surrounding an outer cylindrical surface of the hub. The outer layer has a material of a first density. An inner layer of a second synthetic plastic having a density less than that of the outer layer material is provided surrounding the cylindrical surface and spaced from the axial ends of the hub. The first material surrounds the second material at both the radially outer and axially outer surfaces of the second material.

III. BRIEF DESCRIPTION OF THE DRAWINGS

IV. DESCRIPTION OF THE PREFERRED EMBODIMENT

Referring now to the several drawing figures in which identical elements are numbered identically throughout, a description of the preferred embodiment of the present invention will now be provided.

The present invention is directed toward an in-line skate wheel 10. The wheel 10 includes a hub 12, a foam core ring 14 and a molded polyurethane tire 16.

Figure 1:
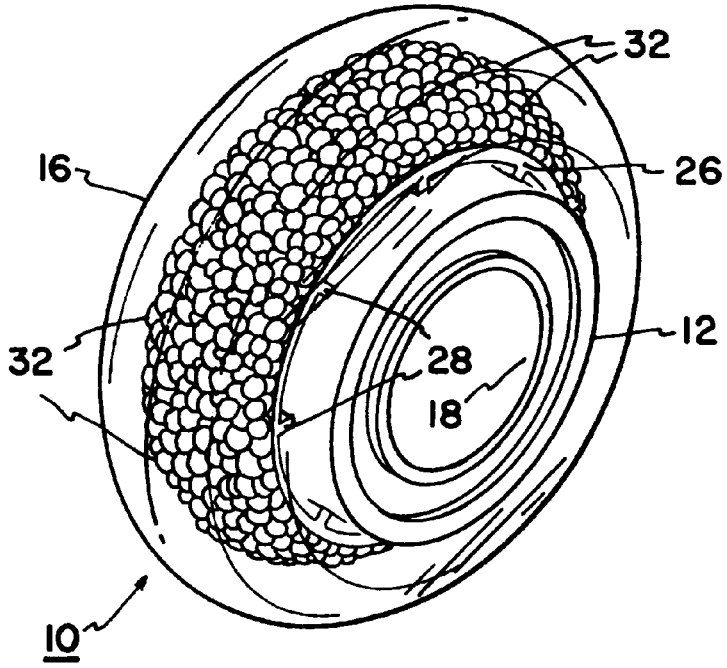
FIG. 1 is a perspective view of an in-line skate wheel according to the present invention.
Figure 5:
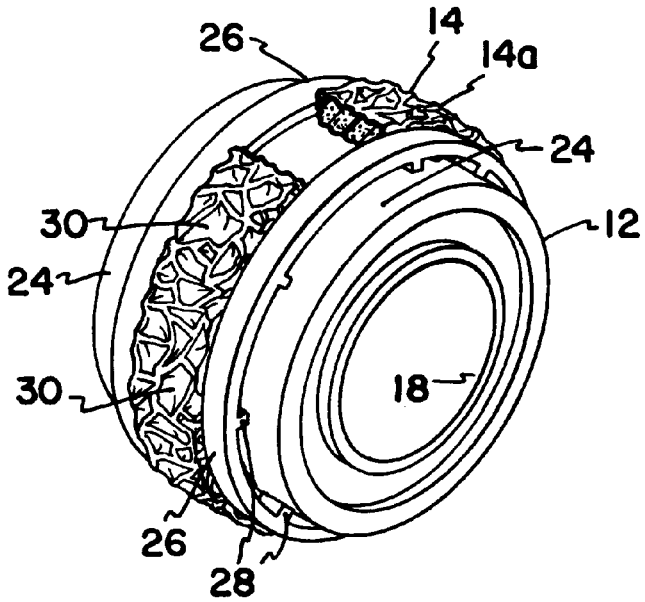
FIG. 5 is a perspective view of a hub and ring with the ring shown partially cut away to expose an interior cross-section.
Figure 4:
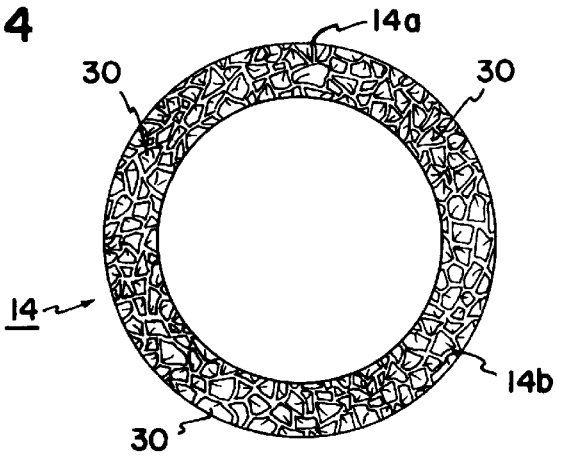
FIG. 4 is a side elevation view of a foam ring for use in the present invention.
Figure 3:
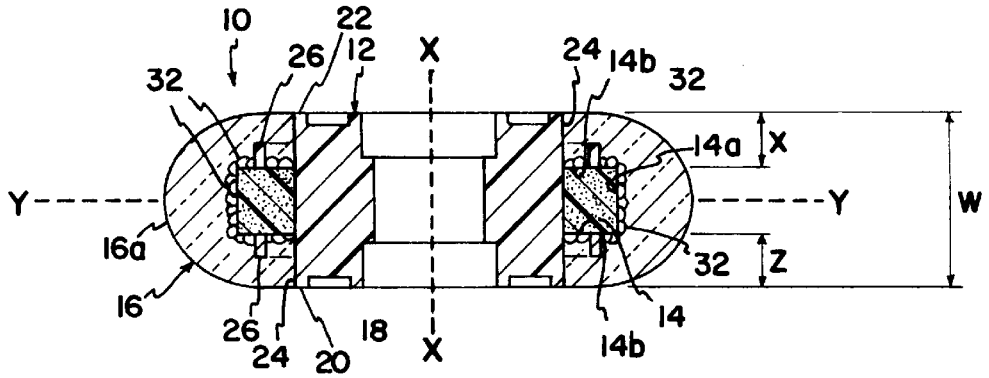
FIG. 3 is a view taken along line 3—3 of FIG. 2.
Figure 2:
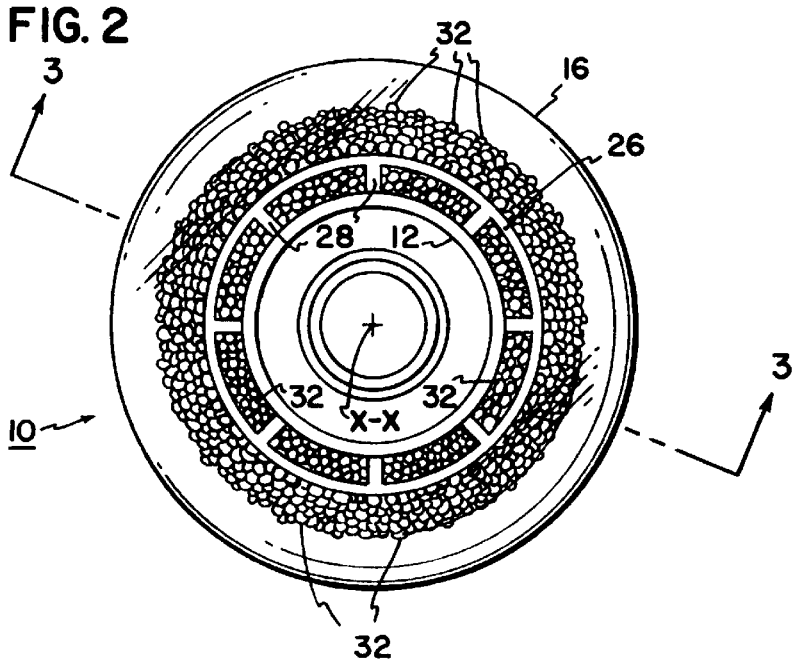
FIG. 2 is a side elevation view of the wheel of FIG. 1 (with the opposite side being substantially identical in appearance)
Figure 6:
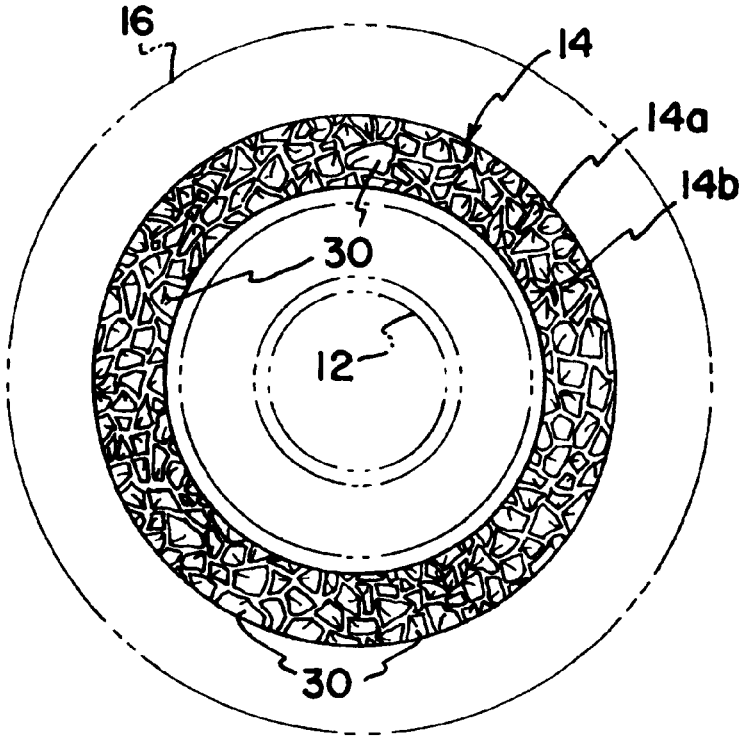
FIG. 6 is a side elevation view of the ring of FIG. 4 with the polyurethane wheel and the plastic hub shown in phantom lines for purposes of illustration.
Figure 7:
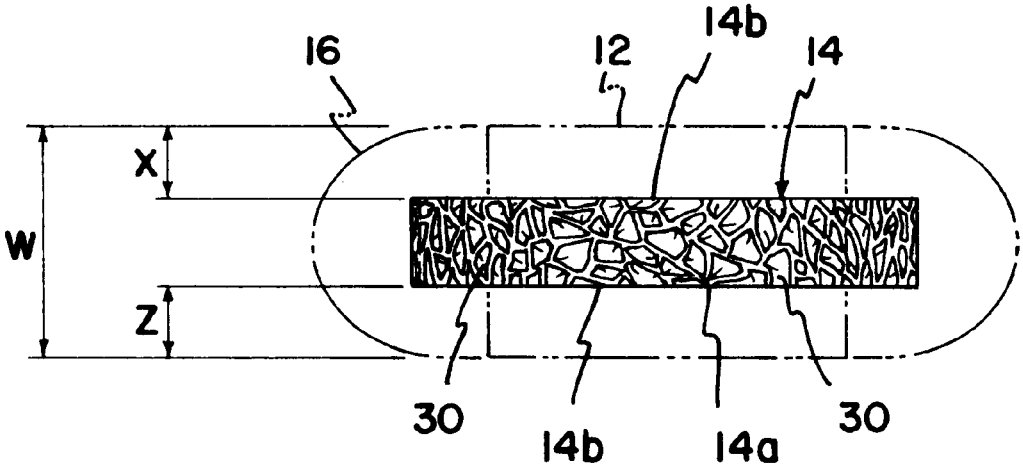
FIG. 7 is a top plan view of the view of FIG. 6.
Figure 8:
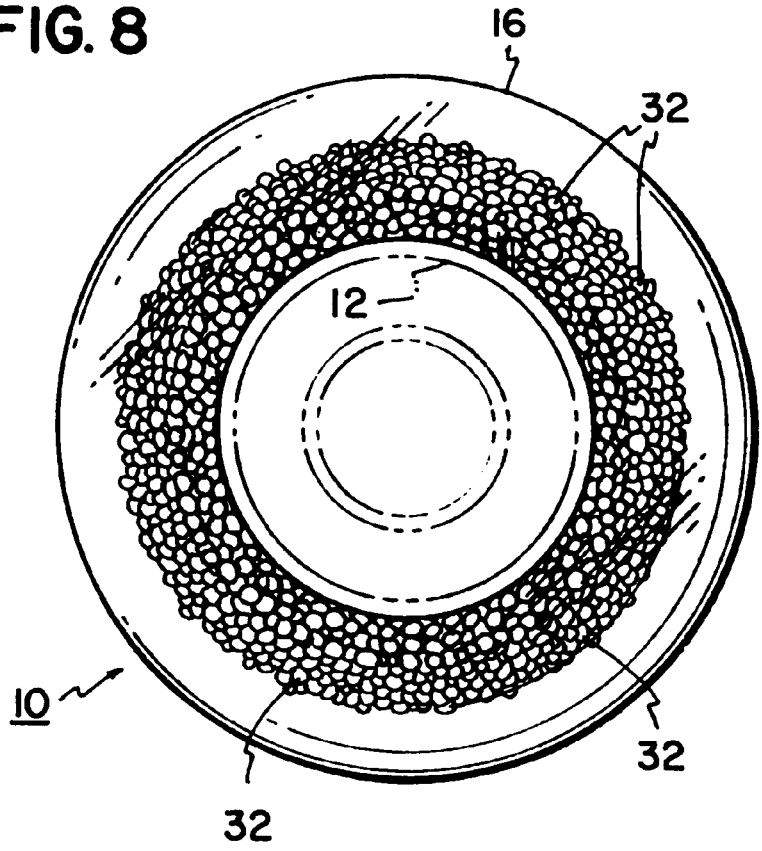
FIG. 8 is a side elevation view of a wheel according to the present invention with internal hub shown in phantom lines for purposes of clarity of illustration.

The hub 12 is conventional. The hub 12 is molded of hard rigid plastic such as nylon, thermoplastic polyurethane and other thermal plastics. The hub 12 has an axially extending bore 18 extending along an axis X—X of the hub 12 from a first axial end 20 to a second axial end 22 (FIG. 3). An outer surface 24 of the hub between the axial ends 20 and 22 is generally cylindrical.

An outer layer (or tire) of a first synthetic plastic material such as polyurethane 16 is molded onto the hub 12 surrounding the cylindrical surface 24. The polyurethane tire 16 has a progressively increasing radial dimension (i.e., the distance from the axis X—X to the outer surface 16*a* of the tire 16) from the axial ends 20, 22 toward the center of the wheel at a central dividing plane Y—Y (extending centrally between and parallel to ends 20,22).

When molding the polyurethane 16, the molten polyurethane 16 forms a chemical bond, a mechanical bond, or both chemical and mechanical bonds with the hub 12. The polyurethane has a density of about 1.02 to 1.2 grams per cubic centimeter.

To resist sheer forces between the polyurethane 16 and the surface 24, anchors 26 are provided. The anchors 26 are integrally molded with the hub material and are rings 26 which are parallel and spaced apart on opposite sides of a center plane Y—Y of the hub and spaced from the surface 24 by ribs 28. With the anchors 26, the molded polyurethane 16 may flow into the spaces defined between the rings 26, surface 24 and ribs 28 to provide a mechanical anchor for the polyurethane tire 16 in addition to any chemical or mechanical bonding between the polyurethane 16 and the surface 24. The use of anchors is particularly desirable with nylon hubs since polyurethane does not bond well with nylon. While the present embodiment illustrates the use of the present invention with polyurethane 16 secured by anchors 26, it will be appreciated that the present invention is applicable to a wheel construction which does not include such anchors 26 but merely provides the polyurethane 16 bonded directly to the hub cylindrical surface 24.

An inner layer of a second synthetic plastic material is provided in the form of a foam core ring 14. The foam core ring 14 is centrally positioned between the ends 20, 22 such that the ring 14 is centrally positioned on the plane Y—Y between anchors 26 and with the ring 14 abutting the surface 24.

The ring 14 is formed of a material having a density which is less than the density of the polyurethane 16. In a preferred embodiment, the ring 14 is a closed cell polyethylene foam having a density of about 0.03 grams per cubic centimeter. While closed cell polyethylene is the preferred material, other materials could be used to form the ring including molded expanded polystyrene. It is desirable that the material of the inner layer 14 have a melting point less than the melting point of the polyurethane 16 to permit the polyurethane 16 to be molded around the ring 14.

As illustrated best in FIG. 3, the molded polyurethane 16 flows to surround the outer cylindrical surface 14*a* of the ring 14 as well as the axial sides 14*b* of the ring 14. Further, the molded polyurethane is directly bonded to the hub at surface 24 on opposite sides of the ring 14.

Direct bonding of the polyurethane 16 to the hub 12 is desirable since polyurethane 16 does not readily bond with the polyethylene ring 14. Instead, the polyethylene is captured within the polyurethane which is in turn, bonded to the hub 12.

In a preferred embodiment, about ½ to ⅔ of the axial length of the surface 24 is bonded directly to the polyurethane 16 such that between ¼ and ⅓ of the axial length is bonded directly to the polyurethane on both of the opposite sides of the ring 14. In other words (and with reference to FIG. 3), the combined length of dimensions Z and X (the length of direct bonding to surface 24) is about ½ to ⅔ of the total width W of the polyurethane 16. Such a degree of direct bonding provides sufficient bonding to resist sheer stress resulting from use of the wheel 10 where the hub has a length of about 1 inch (about 24 millimeters). In other embodiments, the combined length of dimensions Z and X may vary as much as 3/10 to ⅘ of the total width W of the polyurethane 16. Also, the cross-sectional area of the ring 14 is about ½ of the cross-sectional area of the tire 16. This provides a substantial amount of volume reduction by the lower density ring 14 to greatly reduce the weight of the wheel 10. Since the weight of the wheel 10 is so reduced, a harder durometer polyurethane 16 can be utilized without increasing the weight of the wheel 10 but to provide a lower rolling resistance and maintaining the perceived rebound and action of a solid wheel 10.

Figure 12:
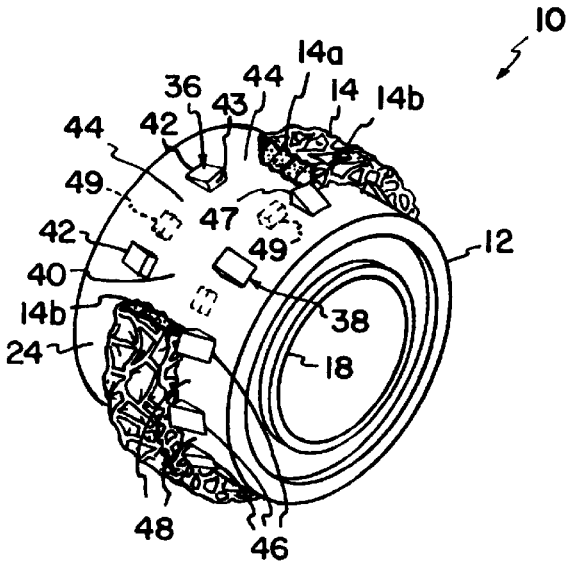
FIG. 12 is a perspective view of the hub and anchors of FIG. 10 and of the ring with the ring shown partially cut away to expose an interior cross-section.
Figure 11:
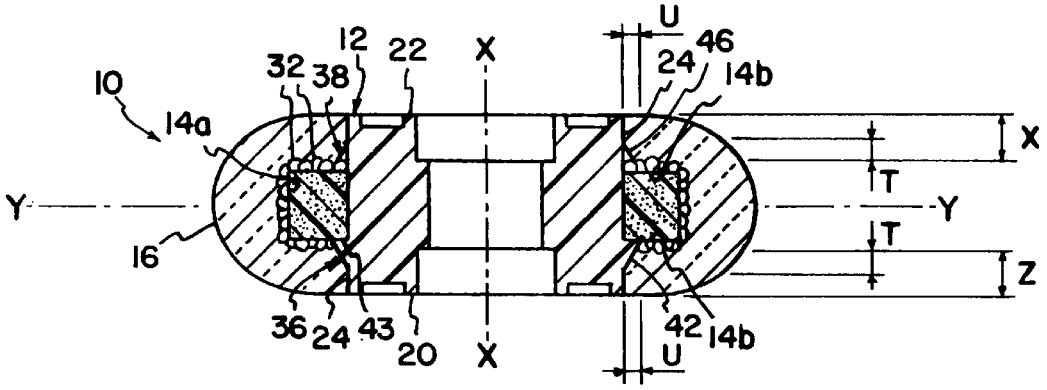
FIG. 11 is a cross-sectional view taken along line 11—11 of FIG. 10.
Figure 10:
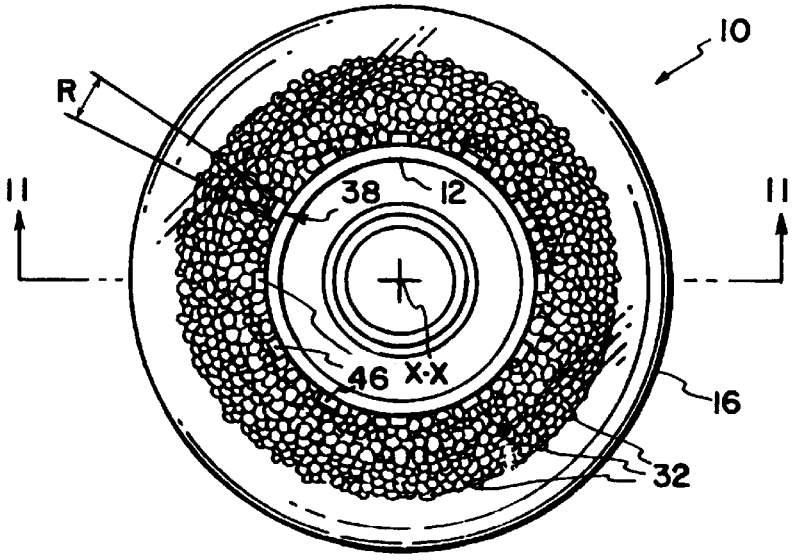
FIG. 10 is a side elevation view of an in-line skate wheel according to the present invention showing a second embodiment of a hub and anchors (with the opposite side being substantially identical in appearance)

With reference to FIGS. 10–12 and 13–15, additional embodiments of anchors for use with the hub 12 and the ring 14 are shown. FIGS. 10–12 show a hub 12 with first and second anchors 36,38 that project radially outward from the outer surface 24 of the hub 12. The anchors 36,38 are integrally molded with the hub material and extend circumferentially around the surface 24 of the hub 12 and are provided in axially spaced-apart relation on opposite sides of a center plane Y—Y of the hub 12 to define a material receiving channel 40 therebetween. The width of the channel 40 is sized to receive the ring 14.

The first anchor 36 includes a plurality of first radial projections 42 separated by first spacing gaps 44. The first radial projections 42 are, preferably, uniformly spaced about the circumference of the surface 24. Similarly, the second anchor 38 includes a plurality of second radial projections 46 separated by second spacing gaps 48. The second radial projections 46 are, preferably, uniformly spaced about the circumference of the surface 24.

In one preferred embodiment, the first and second radial projections 42,46 are staggered relative to one another about the central axis X—X such that the first radial projections 42 align with the second spacing gaps 48 and the second radial projections 46 align with the first spacing gaps 44.

Each of the projections 42,46 is individually distinct and separate from one another. Each radial projection 42,46 slopes radially outward from the surface 24 of the hub 12 toward its respective adjacent axial side 14*b* of the ring 14. Thus, each projection 42,46 is angled relative to the central axis X—X and has an end 43,47 bordering the channel 40 and abutting one of the axial sides 14*b* of the ring 14.

The criteria used to determine the radial length of the ends 43,47 of the projections 42,46, designated by reference dimension U, includes sizing the radial length U to be long enough to retain the ring 14 within the channel 40 when the polyurethane 16 is being molded around the ring 14. In addition, it is also desirable to avoid making the radial length U of the projection ends 43,47 so large that the skater can feel the projections 42,46 within the polyurethane tire 16 when riding on the wheel. The radial length U of the projections 42,46 that is needed to meet the above criteria, however, is largely dependent upon the size of the ring 14. As the radial length of the ring 14 is increased, the radial length U of the projection ends 43,47 should be increased. As the radial length of the ring 14 is decreased, the radial length U of the projection ends 43,47 can be decreased. The size of the ring 14 is dependent upon the type of wheel needed for the particular skate and the type of wheel performance desired. For example, as the cross-sectional area of the ring 14 is increased relative to the cross-sectional area of the polyurethane 16, the wheel will provide more shock absorption and less speed. In contrast, as the cross-sectional area of the ring 14 is decreased relative to the cross-sectional area of the polyurethane 16, the wheel will provide less shock-absorption and greater speed. In one embodiment of a wheel having a hub with an axial width of about 1 inch (about 24 millimeters) and a diameter of about 2 inches, the radial length U of the projection ends 43,47 is preferably not less than 0.030 inches and not greater than 0.187 inches.

The axial length of the projections 42,46, designated by reference dimension T, is configured to create a slope relative to the surface 24 of the hub 12, over which the ring 14 is able to slide to be positioned within the channel 40. A gradual slope along the axial length of the projections 42,46 facilitates sliding the ring 14 over the projections 42,46. When the ring 14 is positioned within the channel 40, the projections 42,46 abut the axial sides 14*b* of the ring 14 at their projection ends 43,47, and can extend to the axial ends 20,22 of the hub 12 for a more gradual slope, or can terminate before the axial ends 20,22 of the hub 12 for a sharper slope. In a preferred embodiment of a wheel with a hub having a diameter of about 2 inches and an axial width of about 1 inch, the projections 42,46 terminate not less than 0.27 inches from the axial ends 20,22 of the hub 12.

The width of the projections 42,46 depends upon the circumference of the hub 12 and the tools used in manufacturing the hub 12. Although it is desirable to have as many projections 42,46 as possible to ensure that the ring 14 is retained within the channel 40 as the polyurethane 16 is molded to the hub 12, the projections 42,46 must be wide enough to resist breaking. In one preferred embodiment of a wheel with a hub having a diameter of about 2 inches and an axial width of about 1 inch, the angle of one of the projections 42,46 around the circumference of the hub 12, designated by angle R in FIG. 10, is approximately 7°.

As will be apparent from reference to FIG. 12, the staggered projections can be configured in a variety of shapes. An alternative configuration of the staggered projections, shown in phantom or dashed lines in FIG. 12, includes substantially rectangular projections or fingers 49 abutting the axial sides 14*b* of the ring 14 and staggered in the same manner as described with reference to the projections 42,46.

Figure 15:
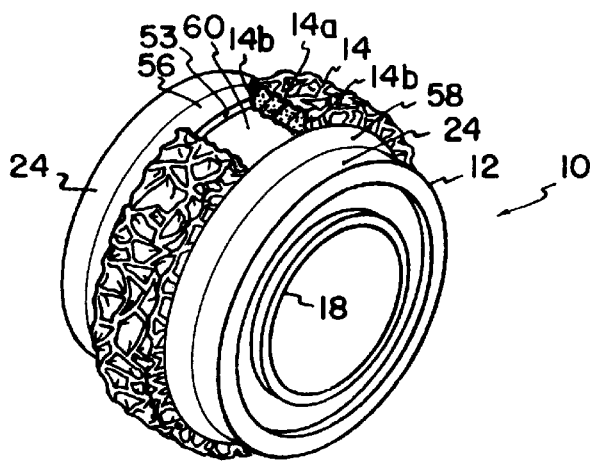
FIG. 15 is a perspective view of the hub and anchors of FIG. 13 and of the ring with the ring shown partially cut away to expose an interior cross-section.
Figure 14:
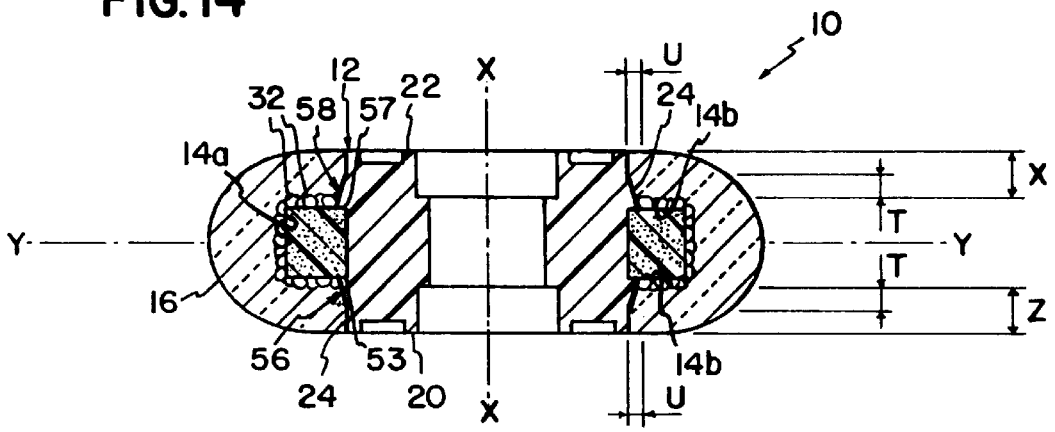
FIG. 14 is a cross-sectional view taken along line 14—14 of FIG. 13.
Figure 13:
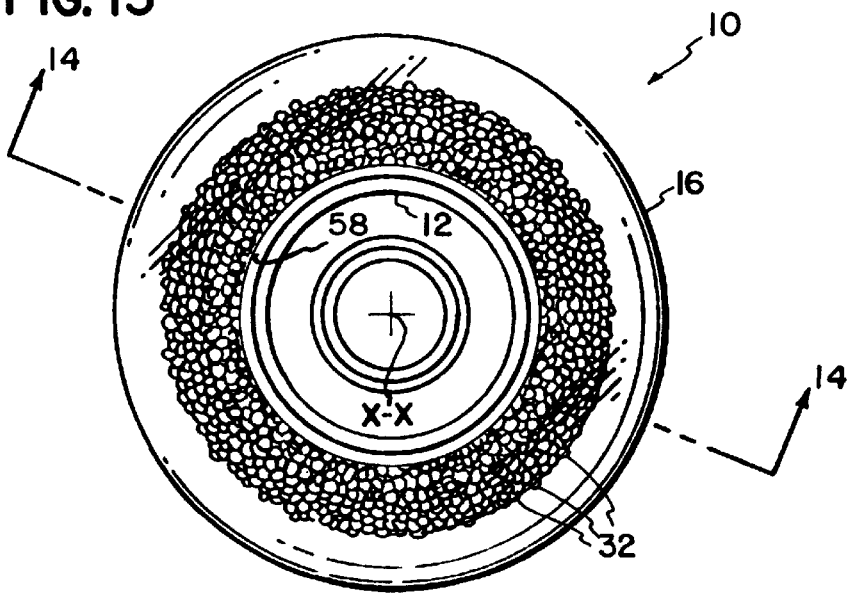
FIG. 13 is a side elevation view of an in-line skate wheel according to the present invention showing another embodiment of a hub and anchors (with the opposite side being substantially identical in appearance)

FIGS. 13–15 show a hub 12 with first and second anchors 56,58 that project radially outward from the outer surface 24 of the hub 12. The anchors 56,58 are integrally molded with the hub material and extend circumferentially around the surface 24 of the hub 12. The anchors 56,58 are substantially parallel and spaced apart on opposite sides of a center plane Y—Y of the hub 12 to define a material receiving channel or recess 60 therebetween. The width of the channel 60 is sized to receive the ring 14.

Each anchor 56,58 slopes radially outward from the surface 24 of the hub 12 toward its respective adjacent axial side 14*b* of the ring 14. Thus, each anchor 56,58 is angled relative to the central axis X—X and has an end 53,57 bordering the channel 60 and abutting one of the axial sides 14*b* of the ring 14. The anchors 56,58 are shaped similarly to the projections 42,46 described with reference to FIGS. 10–12, but the anchors 56,58 do not have spacing gaps and, therefore, are continuous around the surface 24 of the entire circumference of the hub 12. Because the general shape of the anchors 56,58 is similar to the projections 42,46, the configurations and dimensions, including the radial length U and axial length T, described with reference to the projections 42,46 are applicable to the anchors 56,58.

When the anchors include separate and distinct projections on opposite sides of the ring 14 as shown in FIGS. 10–12, then the preferred configuration is the staggered alignment shown and described herein. The staggered configuration of the radial projections 42,46 allows the hub 12 to be manufactured by an injection molding technique that utilizes a mold solely comprising first and second mating pieces. By reducing the complexity of the molding process, fabrication costs of the hub are reduced.

A mold for injection molding a hub with staggered projections as shown in FIGS. 10–12 will now be described. The mold includes first and second axially mating pieces. The pieces include interlocking fingers that cooperate to form the radial projections 42,46 and the channel 40 of the hub 12. The staggered configuration of the radial projections 42,46 allows all of the void areas of the hub 12 to be accessed from an axial direction by the two axially mating pieces. For example, in contrast to other embodiments utilizing axially spaced-apart anchors that extend continuously around the circumference of the hub 12, the radial projections 42,46 do not prevent the first and second axially mating pieces from interconnecting and filling the void that corresponds to the channel 40.

To manufacture the hub 12 and anchors 36,38, the first and second axially mating pieces are interconnected such that the pieces form a mold that defines an interior volume that corresponds with the shape of the hub 12 and anchors 36,38. The interior volume of the mold includes void regions that correspond with the hub 12 and the radial projections 42,46 of the anchors 36,38. Once the first and second axially mating pieces are interconnected, a plastic material is injected into the interior volume defined by the mold. The plastic material is then allowed to cool such that the plastic material hardens within the mold. After the plastic material has hardened, the first and second axially mating pieces are disconnected from one another and the formed hub 12 is removed from the mold. After the hub 12 has been removed from the mold, the ring 14 is fitted within the channel 40. The hub 12 is then subjected to another molding process in which the polyurethane 16 is open or cast molded about the hub 12 to form the wheel 10, as will be hereinafter described in more detail.

It will be apparent to those in the art that unstaggered projections could also be utilized to retain the ring 14. The injection molding process for hubs with unstaggered projections, however, is similar to the injection molding process for hubs with anchors having axially spaced-apart projecting portions extending continuously about the circumference of the hub 12. The injection molding process for such hubs and anchor configurations requires first and second axially mating pieces in addition to third and fourth radially mating pieces that cooperate to form the channel located between the anchors. This is necessary because the anchors prevent the first and second axially mating pieces from axially accessing the channel. Consequently, third and fourth radially mating pieces access the channel from a radial rather than an axial direction.

As previously mentioned, the foam core ring 14 is preferably closed cell polyethylene. The closed cell structure has a plurality of non-communicating cells 30 to limit the polyurethane 16 from flowing into and filling the foam core ring 14. Further, the closed cell structure of the ring 14 results in a plurality of cells 30 being exposed on the external surfaces of the ring 14. The molded polyurethane 16 can flow into the cells 30 to provide an additional mechanical anchor between the polyurethane tire 16 and the ring 14.

When the polyurethane 16 is molded onto the hub 12 and ring 14, the polyurethane 16 has a temperature of about 180–220° F. This temperature expands the air within the cells 30 of the ring 14. The expanded air attempts to migrate out of the ring 14 and forms numerous bubbles 32 on the external surface of the ring 14. With the use of a clear or transparent polyurethane 16, the bubble formation results in an aesthetically pleasing appearance to the wheel 10.

The polyurethane ring 14 may not have precise external geometries and may have surface imperfections. The formation of numerous bubbles 32 on the surface of the polyurethane 14 masks the unsightly foam core 14 as well as masking any surface imperfections.

Further, the bubble layer 32 provides an intermediate layer of lowest density (i.e., air) between the higher density polyurethane 16 and the low density polyethylene 14. As a result, numerous design options are possible. For example, to modify either appearance or performance, the material of the foam core ring 14 (i.e., cell size etc.) may be modified. In a prior art designs consisting solely of molded polyurethane 16, a person attempting to modify the performance of the wheel 10 was restricted in the available design parameters. Namely, such a designer could modify the geometry or the particular selection of the polyurethane to modify performance. In addition to having the option of modifying these design parameters, with the present invention, a designer can modify the geometry and selection of the material of the foam core ring 14. This gives additional factors which can be modified to enhance the designer's option for modifying the performance or appearance of a wheel 10. The addition of the bubble layer 32 is still a third feature such that the size of the bubbles 32 can be modified and the amount of migration of the bubbles 32 into the polyurethane 16 can be modified by affecting the cure rate of the polyurethane. Therefore, a greatly enhanced design flexibility is provided with the present invention for making wheels of a wide degree of bounce, appearance, hardness or the like.

While the present invention has been described with respect to a polyethylene foam, it has been mentioned that the ring could be an extended polystyrene. While no bubbles would form with an expanded polystyrene, such a ring could be easily cast into a wide variety of geometries.

Figure 9:
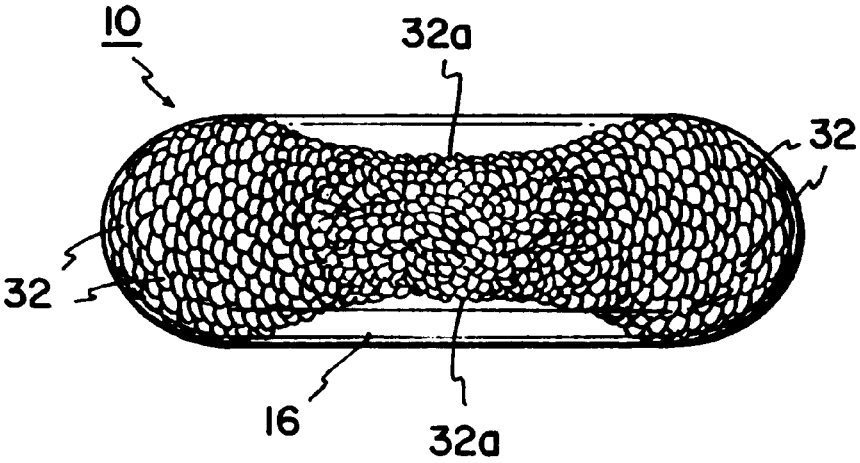
FIG. 9 is a top plan view of wheel of FIG. 8.

In the figures, the bubble field 32 is shown surrounding the ring 14 and masking the ring 14 from view. It should be noted in FIG. 9 that the bubble field 32 has an hour-glass appearance resulting in concave sidewalls 32*a*. It will be appreciated that the illustration of FIG. 9 shows an illusion resulting from diffraction of light passing through the transparent polyurethane 16 from the bubble field 32 to give an illusion of curved walls 32*a*.

From the foregoing detailed description of the present invention it has been shown how the objects of the invention have been attained in a preferred manner. Modification and equivalents of the disclosed concepts such as those which readily occur to one skilled in the art are intended to be included within the scope of the claims which are appended hereto.

What is claimed is:

1. A skate wheel comprising:

a generally cylindrical hub having an axially extending axle opening, said hub further having first and second axial ends separated by a cylindrical surface;

an outer layer of a first synthetic plastic material having a first density;

an inner layer of a second synthetic plastic material having a second density less than said first density, said inner layer being generally centrally positioned surrounding said cylindrical surface and spaced from said axial ends;

first and second anchors projecting radially outward from said hub and extending circumferentially about said hub, said first and second anchors being disposed in axially spaced-apart relation, said first and second anchors and said cylindrical surface defining an outwardly opening central channel, said channel sized to receive said inner layer with said inner layer being retained in said channel; and said first material surrounding said inner layer on at least radially outer and axially outer surfaces of said inner layer with said first material molded onto said hub and surrounding said cylindrical surface such that said first material and said cylindrical surface encapsulate said inner layer, an outer surface of said first material having a progressively increasing radial dimension from said axial ends toward a center of said hub.

2. A skate wheel according to claim 1 wherein said inner layer includes an annular foam ring having a density less than said first density.

3. A skate wheel according to claim 1 wherein said foam is a closed cell foam.

4. A skate wheel according to claim 1 wherein said inner layer is a closed cell foam.

5. A skate wheel according to claim 1 wherein said first and second anchors comprise outer rings spaced from said hub and extending circumferentially and continuously about said hub, each of said anchors including a plurality of ribs separated by circumferential spaces, said ribs connecting said outer rings to said hub.

6. A skate wheel according to claim 1 wherein said first anchor includes a plurality of first radial projections separated by first spacing gaps and said second anchor includes a plurality of second radial projections separated by second spacing gaps, said first and second radial projections being staggered relative to each other about the circumference of said hub such that said first radial projections are aligned with second spacing gaps and said second radial projections are aligned with said second spacing gaps.

7. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

said first material surrounding said second material on at least radially outer and axially outer surfaces of said second material with an outer surface of said first material having a progressively increasing radial dimension from said axial ends toward a center of said hub;

at least a first anchor projecting radially outward from said hub; and wherein said outer layer is a molded polyurethane material and said inner layer includes an annular foam ring, said ring generally centrally positioned surrounding said cylindrical surface and spaced from said axial ends; said molded polyurethane material molded onto said hub and surrounding said cylindrical surface, said first anchor, and said ring, said molded polyurethane retained on said hub by said first anchor.

8. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

said first material surrounding said second material on at least radially outer and axially outer surfaces of said second material with an outer surface of said first material having a progressively increasing radial dimension from said axial ends toward a center of said hub;

first and second anchors projecting radially outward from said hub and extending circumferentially about said hub, said first and second anchors being disposed in axially spaced-apart relation such that an outwardly opening central channel is defined therebetween, said channel sized to receive said inner layer with said inner layer being retained in said channel between said first and second anchors; and wherein said first and second anchors comprise outer rings spaced from said hub and extending circumferentially and continuously about said hub, each of said anchors including a plurality of ribs separated by circumferential spaces, said ribs connecting said outer rings to said hub.

9. A skate wheel according to claim 8 wherein said outer layer is a molded polyurethane material and said inner layer includes an annular foam ring, said ring generally centrally positioned surrounding said cylindrical surface and spaced from said axial ends.

10. A skate wheel according to claim 9 wherein said molded polyurethane material is molded onto said hub and surrounds said cylindrical surface and said ring such that said molded polyurethane material and said cylindrical surface encapsulate said ring.

11. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

said first material surrounding said second material on at least radially outer and axially outer surfaces of said second material with an outer surface of said first material having a progressively increasing radial dimension from said axial ends toward a center of said hub;

first and second anchors projecting radially outward from said hub and extending circumferentially about said hub, said first and second anchors being disposed in axially spaced-apart relation such that an outwardly opening central channel is defined therebetween, said channel sized to receive said inner layer with said inner layer being retained in said channel between said first and second anchors; and wherein said first anchor includes a plurality of first radial projections separated by first spacing gaps and said second anchor includes a plurality of second radial projections separated by second spacing gaps, said first and second radial projections being staggered relative to each other about the circumference of said hub such that said first radial projections are aligned with second spacing gaps and said second radial projections are aligned with said second spacing gaps.

12. A skate wheel according to claim 11 wherein said outer layer is a molded polyurethane material and said inner layer includes an annular foam ring, said ring generally centrally positioned surrounding said cylindrical surface and spaced from said axial ends.

13. A skate wheel according to claim 12 wherein said molded polyurethane material is molded onto said hub and surrounds said cylindrical surface and said ring such that said molded polyurethane material and said cylindrical surface encapsulate said ring.

14. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

first and second anchors projecting radially outward from said hub and extending circumferentially about said hub, said first and second anchors being disposed in axially spaced-apart relation, said first and second anchors and said cylindrical surface defining an outwardly opening central channel, said channel sized to receive said inner layer with said inner layer being retained in said channel between said first and second anchors; and said first material surrounding said inner layer on at least radially outer and axially outer surfaces of said inner layer, said first material molded onto said cylindrical surface between said axial ends of said cylindrical surface and said axially outer surfaces of said inner layer, with an outer surface of said first material having a progressively increasing radial dimension from said axial ends toward a center of said hub.

15. A skate wheel according to claim 14 wherein said outer layer is a molded polyurethane material and said inner layer includes an annular foam ring, said ring generally centrally positioned surrounding said cylindrical surface and spaced from said axial ends.

16. A skate wheel according to claim 15 wherein said molded polyurethane material is molded onto said hub and surrounds said cylindrical surface and said ring such that said molded polyurethane material and said cylindrical surface encapsulate said ring.

17. A skate wheel according to claim 14 wherein said first and second anchors comprise outer rings spaced from said hub and extending circumferentially and continuously about said hub, each of said anchors including a plurality of ribs separated by circumferential spaces, said ribs connecting said outer rings to said hub.

18. A skate wheel according to claim 14 wherein said first anchor includes a plurality of first radial projections separated by first spacing gaps and said second anchor includes a plurality of second radial projections separated by second spacing gaps, said first and second radial projections being staggered relative to each other about the circumference of said hub such that said first radial projections are aligned with second spacing gaps and said second radial projections are aligned with said second spacing gaps.

* * * * *